US005293305A

United States Patent [19]

Koster

[11] Patent Number: 5,293,305

[45] Date of Patent: Mar. 8, 1994

[54] LIGHT GUIDANCE SYSTEM FOR THE ILLUMINATION OF AN INTERIOR AREA

[76] Inventor: Helmut Koster, Karl-Bieber-Hohe 15, D-6000 Frankfurt (Main) 56, Fed. Rep. of Germany

[21] Appl. No.: 743,318

[22] PCT Filed: Feb. 27, 1990

[86] PCT No.: PCT/DE90/00131

§ 371 Date: Aug. 20, 1991

§ 102(e) Date: Aug. 20, 1991

[87] PCT Pub. No.: WO90/10176

PCT Pub. Date: Sep. 7, 1990

[30] Foreign Application Priority Data

Feb. 28, 1989 [DE] Fed. Rep. of Germany ..... 3906229
May 23, 1989 [DE] Fed. Rep. of Germany ..... 3916688

[51] Int. Cl.[5] ..... F21S 3/14; F21V 7/09

[52] U.S. Cl. ..... 362/147; 362/290; 362/346; 126/686

[58] Field of Search ..... 126/439, 685, 686; 362/147, 260, 297, 298, 299, 300, 326, 342, 346, 347, 290

[56] References Cited

U.S. PATENT DOCUMENTS

| | | | |
|---|---|---|---|
| 693,088 | 2/1902 | Wadsworth | 362/342 |
| 3,113,728 | 12/1963 | Boyd | 362/147 |
| 4,220,137 | 9/1980 | Tesch et al. | 126/439 |
| 4,223,663 | 9/1980 | Carmichael et al. | 126/439 |
| 4,228,789 | 10/1980 | Kay | 126/439 |
| 4,337,754 | 7/1982 | Conger | 126/439 |
| 4,351,588 | 9/1982 | Züllig | 126/439 |

FOREIGN PATENT DOCUMENTS

| | | | |
|---|---|---|---|
| 1154774 | 9/1963 | Fed. Rep. of Germany | 362/147 |

*Primary Examiner*—Richard R. Cole
*Assistant Examiner*—Y. Quach
*Attorney, Agent, or Firm*—Koda and Androlia

[57] ABSTRACT

A light guidance system for the illumination of an interior area with a light deflection device which reflects daylight coming from outside of the interior area as well as artificial light coming from inside of the interior area. The light deflection device comprises several elements disposed parallel to one another and spaced apart from one another such that light from outside of the interior area can penetrate through the space into the interior area, and each of said several elements has at least one reflector surface and is impervious to light.

18 Claims, 5 Drawing Sheets

Figure 1:
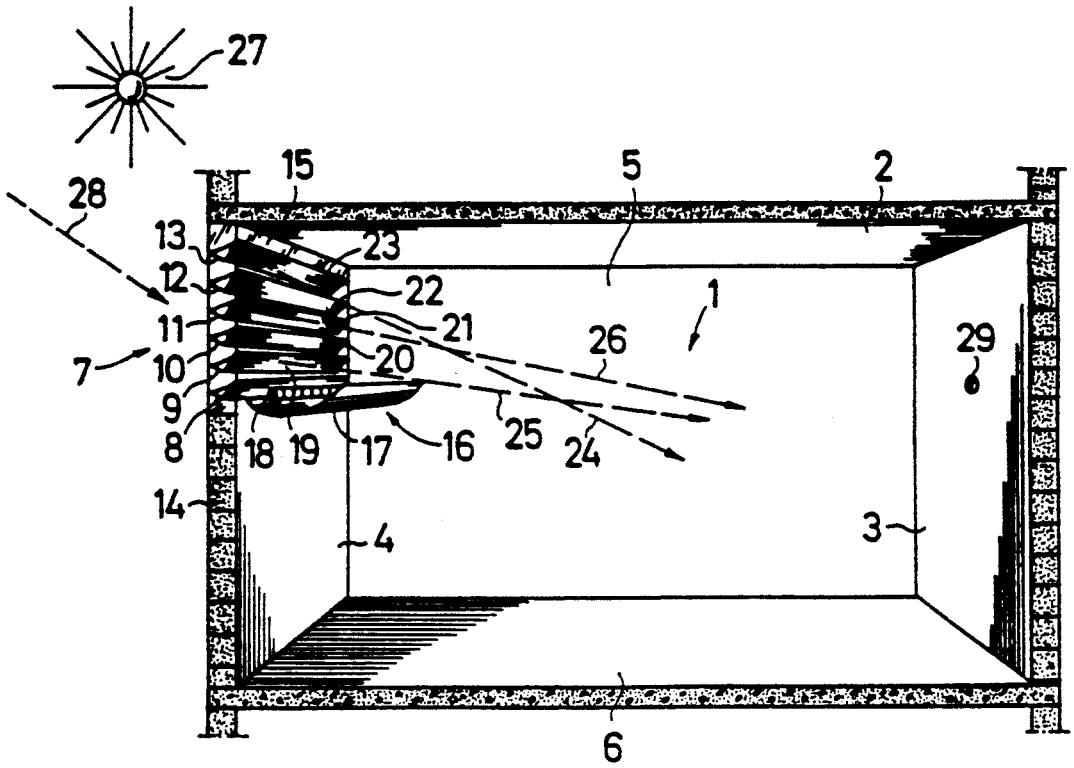

LIGHT GUIDANCE SYSTEM FOR THE ILLUMINATION OF AN INTERIOR AREA the invention relates to a light guidance system according to the preamble of patent claim 1.

In the wake of increased use of solar energy to overcome energy problems passive light guidance systems have increasingly gained in importance. With such passive systems for example the sunlight is controlled in such a way that in winter it is permitted to pass and in summer it is reflected. Hereby in winter active heating elements and in summer active cooling elements can be dispensed with or they can at least be significantly reduced.

In a known arrangement for the automatic control of the incidence of light with light-impermeable wall parts disposed parallel one above the other and at a distance from one another the energy passage or the shading during the seasonal transition period is precisely determined (EP-C-0 029 442). However, this arrangement is only intended for regulating daylight.

A device for illuminating rooms with daylight and artificial light is, however, also known in which a first reflector projects daylight and a second reflector artificial light onto the ceiling of a room so that in both cases indirect lighting results (DE-B-631 798). Of disadvantage herein is that the first reflector projects toward the outside like an extended window sill while the second reflector is fastened on the ceiling in the manner of a lamp shade reflecting upward.

In another show-window illumination a transparent protective roof of prism glass is disposed above the show-window opposite an obliquely disposed mirror (DE-B-517 827). The light falling through the protective roof is therein guided onto the items exhibited in the show-window. On the ceiling of the show-window room, furthermore, is disposed a luminaire whose light falls directly and via the mirror onto the items exhibited. Although the mirror reflects artificial as well as also natural light the entire illumination device is very expensive because it requires a cumbersome protective roof.

Furthermore, a method for the distribution of light in a closed room with at least one window face as room boundary is known in which the window of the window face is horizontally divided into two unequal parts and specifically into a translucent upper window and into a transparent view window (DE-A-37 29 553). Herein the light through the upper window is carried nearly horizontally or slightly obliquely with respect to a reflecting ceiling surface while the light streaming in through the view window experiences behind this window a deflection in the upward direction against the reflecting ceiling surface. Of disadvantages in this known method is the division into two window portions because this division requires bars and fins which are horizontally oriented and projecting.

Also known is an arrangement for the illumination of interior areas with natural daylight having a light channel between a building ceiling and a drop ceiling (DE-A-35 45 419). Herein a light collector is provided on the outside of the building before the light channel and a band-form light distribution device adjoining the light channel for the distribution and guidance of the daylight into the interior of the room. This light distribution device can be provided additionally with an artificial light band. Of disadvantage in this arrangement is the fact that the room is made smaller through the drop ceiling and a light collector projecting toward the outside is required. The same disadvantage is true of another known arrangement for illuminating inner rooms in which a transparent ceiling is hung below the building ceiling (DE-A-35 23 523).

With a further known method for controlling in rooms radiation energy in the entire spectral range without use of external energy maximum advantageous conditions with respect to light, heat, and sound are said to be created throughout the entire room (EP-B-0 020 296). In order to achieve this goal, on the one hand, rays generated in the room itself as well as also in other places and radiated in through the window and deflected through reflectors in the direction of the room ceiling are deflected in the region of the room ceiling through reflectors implemented as pyramids with triangular base and with alternatingly raised and indented peaks primarily in the rearward direction into the depth of the room and laterally into the width of the room. Of disadvantage herein is that the room ceiling must be masked out with prism-like structures.

In another known device for illuminating poorly lit work places in rooms through azimuthal light, optical means are used which are suitable to direct light incident from the zenith through deflection toward the work place (CH-A 194 867). These optical means comprise two reflectors disposed one above the other wherein the lower one catches the azimuthal light and deflects it toward the upper reflector which projects it at the required angle into the work space. This device is not suitable for the guidance of artificial light generated in the room itself.

Furthermore an arrangement for the generation of indirect light is known having U-form reflector elements in which are disposed fluorescent tubes (U.S. Pat. No. 4,388,675). This arrangement, however, cannot be used in place of a conventional window pane.

Lastly, an arrangement for increasing the illumination with natural light is also known in which a row of completely or partially reflecting blinds or fins is disposed so that the natural light is reflected from their underside in the downward direction (DE-A-34 21 063). This arrangement, however, is not suitable for reflecting artificial light in a predetermined manner into a room.

Building on DE-B-517 827 the invention is based on the task of creating a light guidance arrangement which guides daylight as well as also artificial light simultaneously in such a way that in all cases indirect illumination results.

This task is solved according to the features of patent claim 1.

The advantage achieved with the invention resides in particular therein that during the day as well as also at night uniform and indirect lighting of a room is possible without needing to use awkward light deflection systems.

Figure 2:
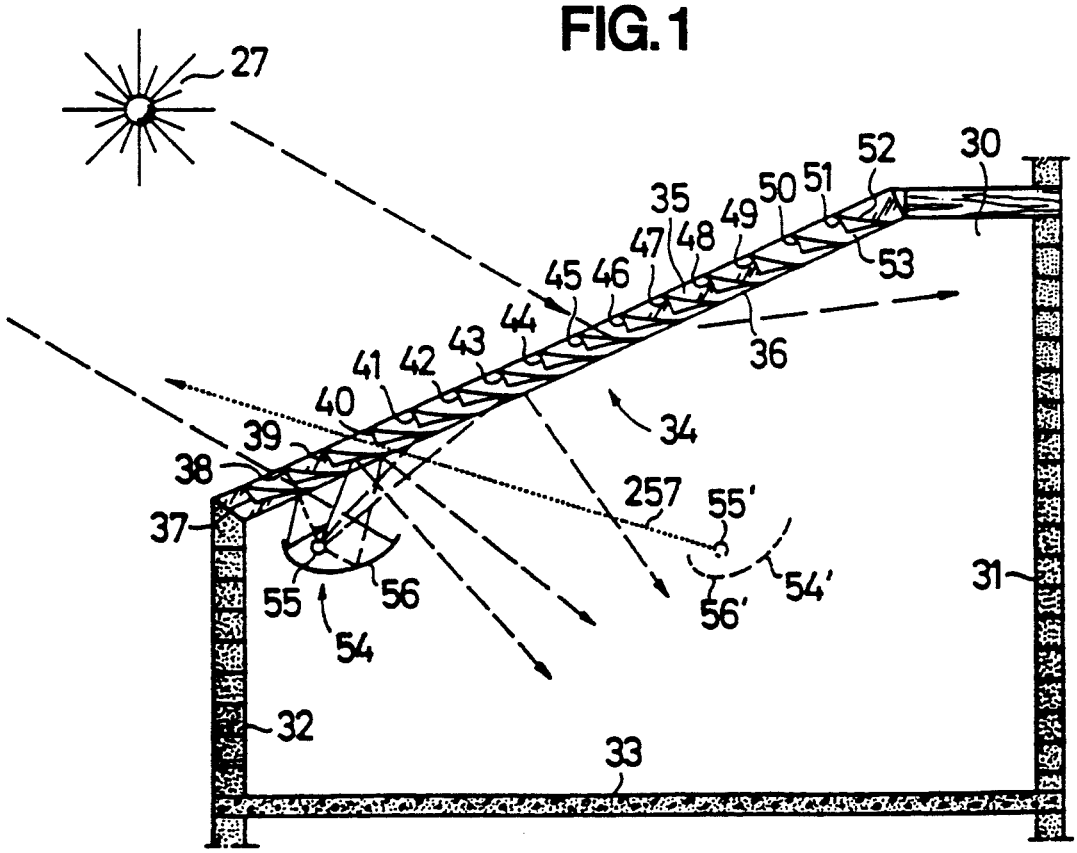
Figure 3:
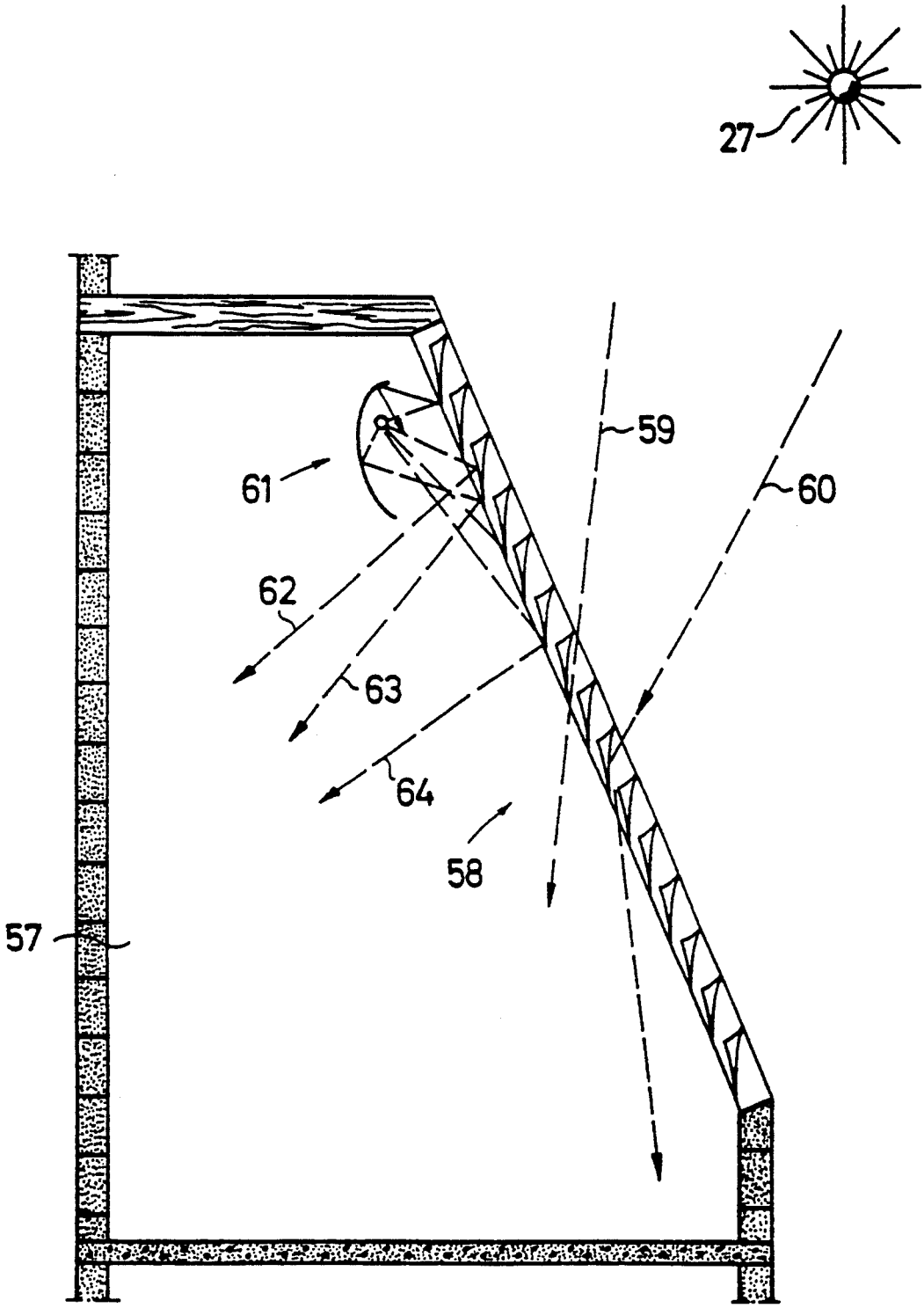
Figure 4:
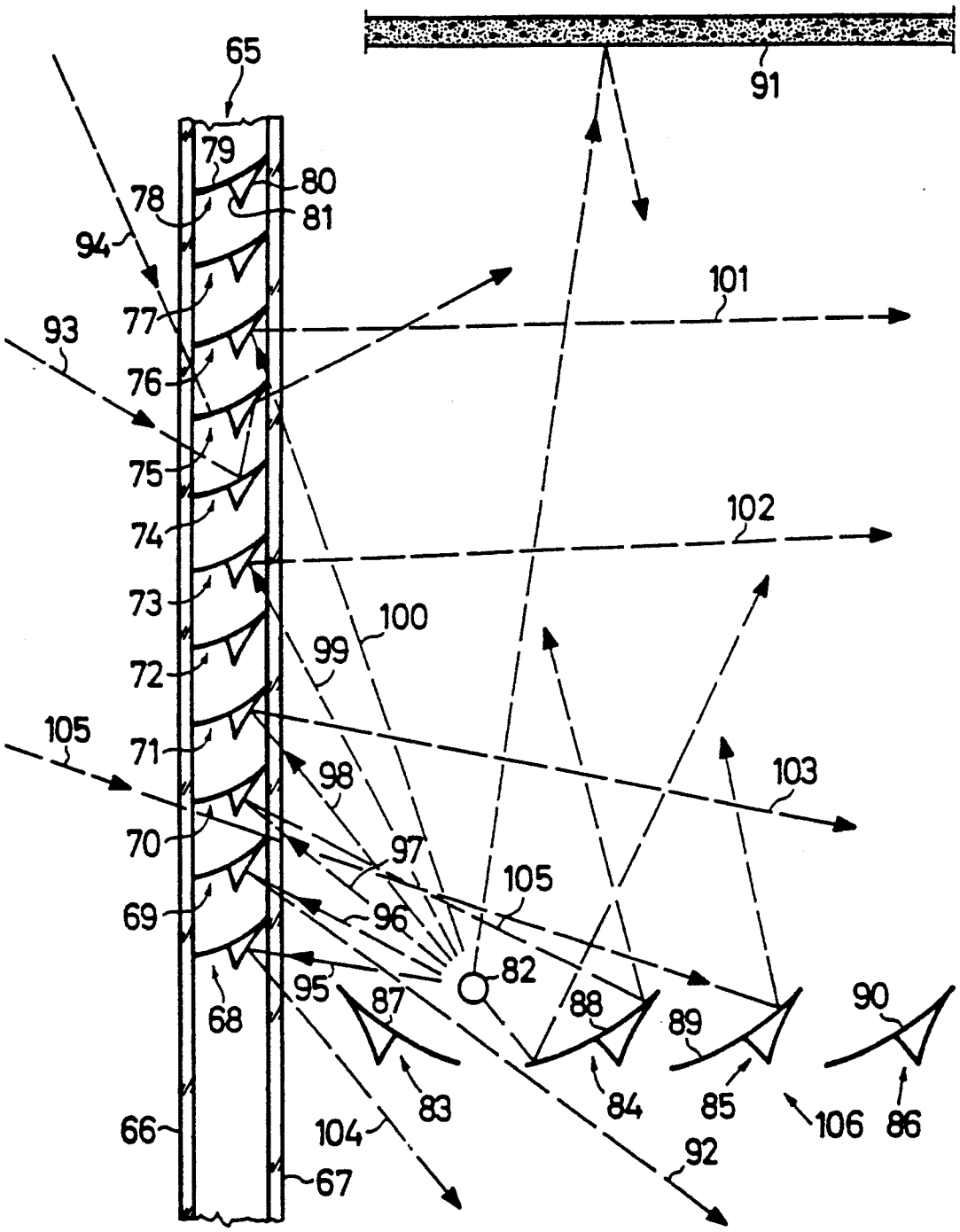
Figure 5:
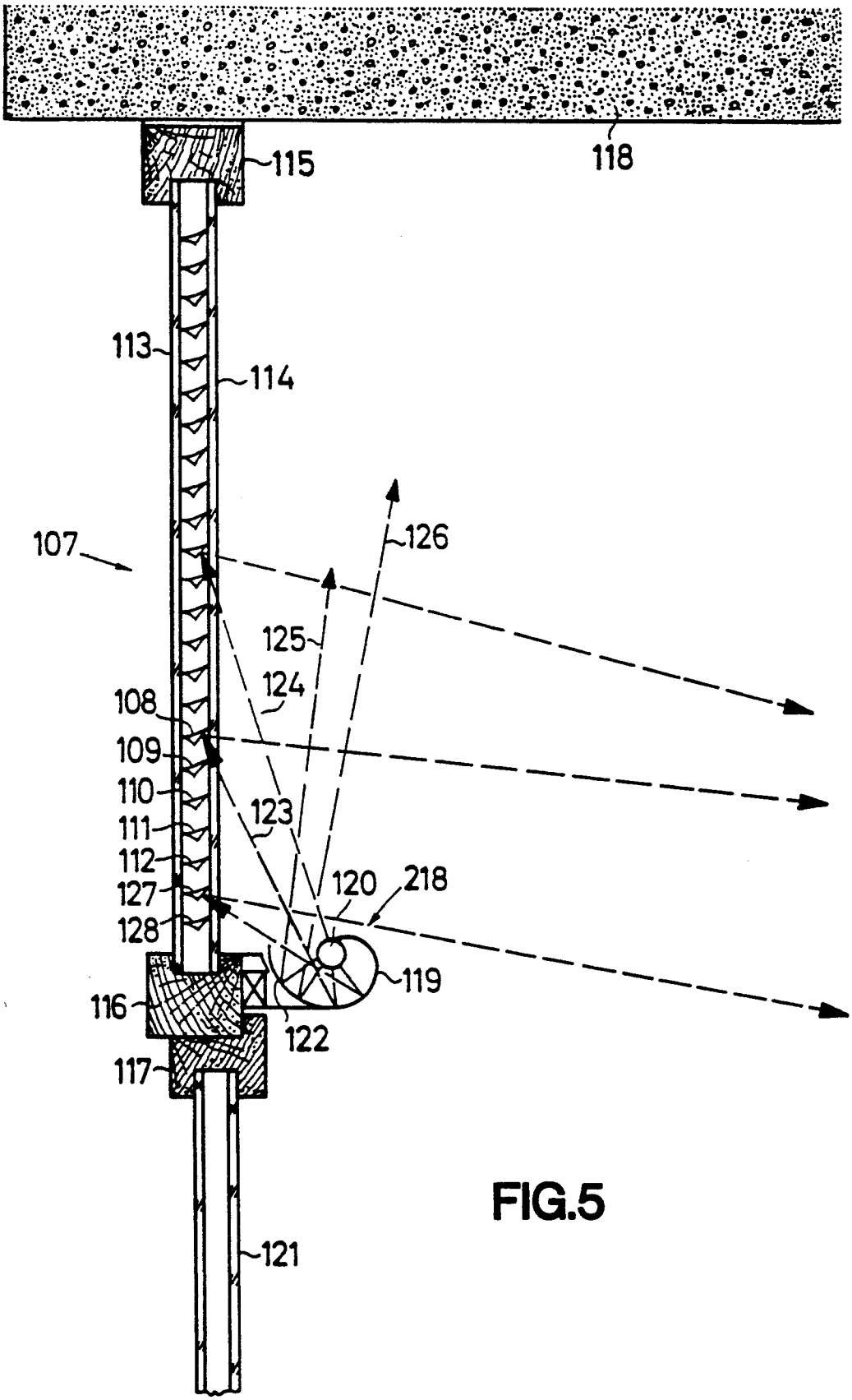
Figures 6, 7:
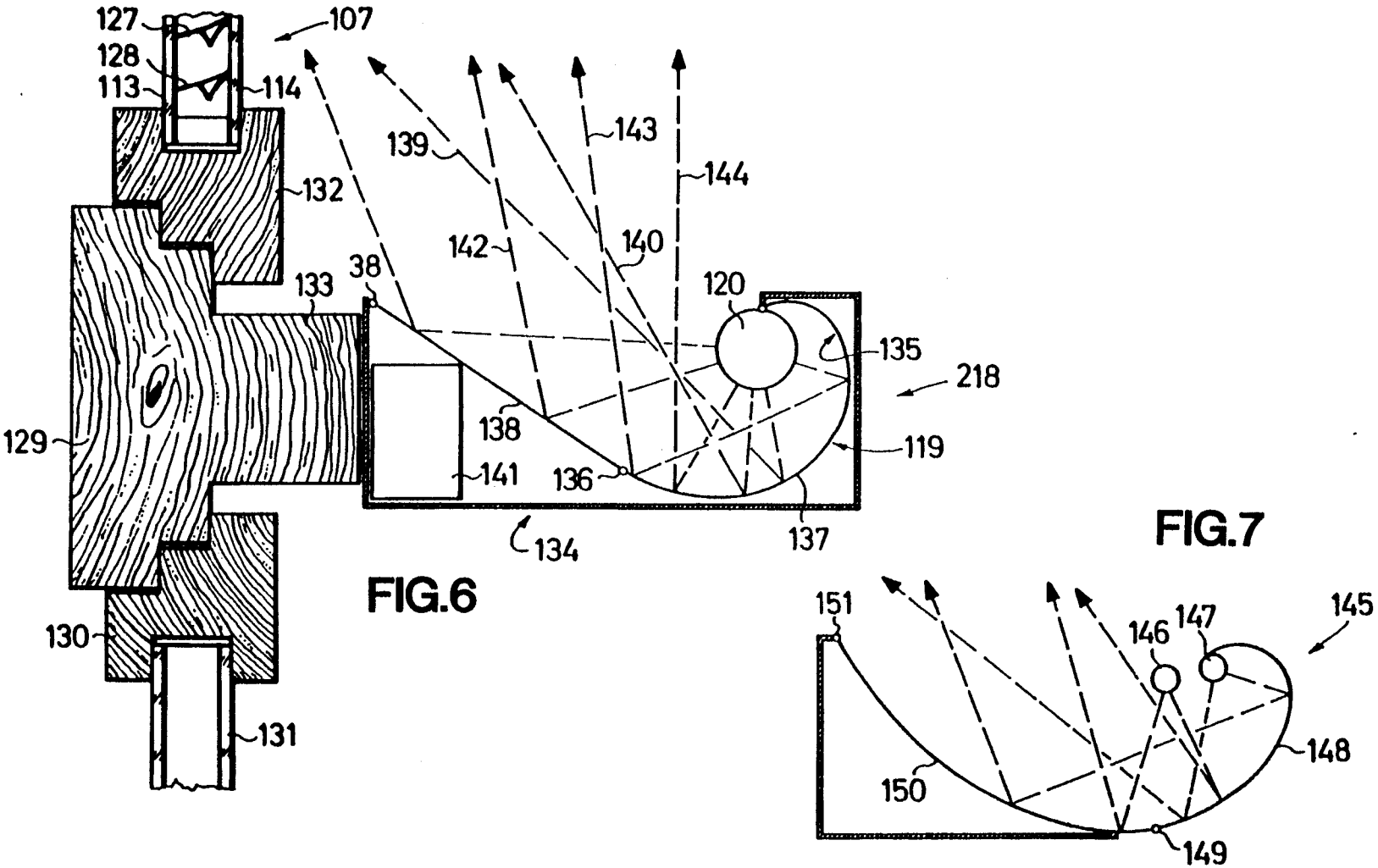

Embodiment examples of the invention are represented in the drawing and are described in greater detail in the following. Therein show:

FIG. 1 a perspective representation of an interior room having in the upper area of a window wall a light guidance arrangement according to the invention;

FIG. 2 a section through an attic room with a slightly inclined glass roof having a light deflection arrangement according to the invention;

FIG. 3 a section through an attic room with a steeply inclined glass roof having a light deflection arrangement according to the invention;

FIG. 4 a section through a light deflection arrangement according to the invention with several reflector profiles for the deflection of artificial light;

FIG. 5 a section through a light deflection arrangement according to the invention with a special reflector for the artificial light source;

FIG. 6 a section through a window frame casement construction with an artificial light source;

FIG. 7 a section through an artificial light source with two fluorescent tubes.

In FIG. 1 is shown a section through an interior room 1 with a ceiling 2, two first side walls 3, 4 and two second side walls of which only the one side wall 5 is visible, as well as with a floor 6. In the upper area of the side wall 4 is disposed a light guidance system 7 according to the invention having several reflectors 8 to 13 disposed parallel to one another and one above the other and within a double window structure with the two panes 14, 15. In the area of the lower reflector 8 and at a distance of less than 70 cm is disposed an artificial light illumination 16 comprising a curved reflector 17 and a line-form light source, for example a fluorescent luminaire 18.

The reflector 17 is white or reflecting on its upper side. It comprises for example aluminum with a metallic shining surface or a comparable material. The light from the fluorescent luminaire 18 arrives on room-side reflector areas 19 to 23 of reflectors 9 to 13 and from there is reflected back into the room 1 which is indicated through light rays 24, 25, 26. The light 28 coming from the sun 27 is also deflected by the light guidance system 7 and specifically as a function of the angle of incidence either on the ceiling 2 or to the outside again.

The function of the light guidance system 7, consequently, resides therein for example to provide shading for a window work place and to guide the light—whether artificial or daylight—to the ceiling 2 or into the depth of the room. Due to the double function of the light guidance system 7 it is also readily possible to produce a constant lighting. To this end only the artificial light source 18 needs to be controlled as a function of the outside brightness. To the extent to which the daylight becomes stronger or weaker, the artificial light can become weaker or stronger. Instead of regulating an individual tube which in the case of incandescent tubes is simple however difficult in the case of fluorescent tubes, it is also possible to add several tubes stepwise. Consequently, a daylight state can be obtained independently of the daylight intensity without it becoming necessary to switch immediately over to a night situation which consumes more energy than is in fact necessary for illumination throughout the day. The daylight-dependent regulation can take place by hand. However, regulation via a photocell 29 is useful which can be disposed for example in the interior room at the deepest point of the room.

An essential feature of the invention resides in the close spatial-optical relationship between the artificial lighting 16 and the window zone with the light guidance system 7. In general window areas when viewed from the interior of the room are considered as black surfaces i.e. they are practically ineffective as reflectors because the light impinging upon them is lost toward the outside. In the invention, however, precisely the window area is illuminated with artificial light from below. The illumination takes place therein at a minimum angle so that no artificial light penetrates to the outside.

FIG. 2 represents a vertical section through an attic room 30 of which can be seen three walls 31, 32, 33 and as roof incline a light guidance system 34. The light guidance system 34 is, in turn, installed between two panes 35, 36 and comprises several reflectors 37 to 51 which are implemented as reflector profiles with at least one reflector surface 52 directed toward the outside and one reflector surface 53 directed toward the inside. Below the light guidance system 34 is disposed an artificial lighting 54 at a maximum distance of one meter comprising a luminaire 55 and a reflector 56 of the type of a reflector screen. The artificial lighting 54 radiates again from below or obliquely onto the light guidance system 34. If the artificial lighting 54 were shifted into the interior room into the position 54', 55', 56' indicated in dashed lines the advantageous effect would no longer be given because the artificial light would penetrate through the light guidance system 34 to the outside and would be lost which is indicated through the ray of light 257.

In FIG. 3 is shown a section through an interior room 57 in which a light guidance system 58 is constructed so that it is permeable for the high sky radiation 59, 60. In this case the artificial lighting 61 is installed above i.e. the artificial light is radiated from above obliquely onto the light guidance system 58 and from there reflected into the interior room 57 which is indicated with the rays of light 62 to 64. The oblique impingement of the light guidance system 58, consequently, takes place from a direction from which the sky or the outside space is not visible.

The light guidance system comprises in the Figures in each instance individual reflecting profiles. These are completely or partially made reflective depending on whether a diffuse light dispersion or a precise light guidance takes place. For example the reflector portions directly impinged upon by the sun 27 are usefully to be implemented so as to be shining in order to be able to exercise a precise control onto the light passage while the reflector portions 53 impinged upon by artificial light can be implemented for example so as to be white-reflecting whereby a diffuse light distribution toward the interior room is achieved. Instead of reflectors 37 to 51 prisms can also be provided in the light guidance system wherein however at least the prism side impinged upon by the artificial light must be implemented so as to be reflecting. As prisms can serve preferably prism rods or prism plates. A prism plate comprises herein a light-permeable plate which has at least on one side prismatic forms.

It may be unavoidable under certain circumstances that small fractions of the artificial light escape toward the outside since the angle of the artificial light impingement from the inside varies with the distance of the individual reflectors of the light guidance system from the artificial light source. It is, however, sufficient if the major portion of the artificial light is reflected back into the interior room.

FIG. 4 shows the cross section through a light guidance system 65 in the air space of an insulating window with two panes 66, 67. This light guidance system 65 comprises again several reflectors 68 to 78 which comprise essentially three reflector parts 79, 80, 81. The reflector part 79 is curved parabolically and extends from the inner wall of the pane of glass 66 to the inner wall of the pane of glass 67. The one end of the reflector part 79 is conjoined by the reflector part 80 which is approximately only half as large as the reflector part 79. It extends at an angle of approximately 25 degrees downward and is connected with its end with the third reflector part 81 which is disposed perpendicularly on the reflector part 79.

Slightly below the lowest reflector 68 and at a distance from the pane 67 is disposed a fluorescent tube 82 flanked on both sides by in each instance the reflectors 83, 84 which are implemented in the same way as reflectors 68 to 78. To the right of the reflector 84 and approximately at the same level are disposed two further reflectors 85, 86 built in the same way.

The luminaire 82 is any given radiator such as for example an HQI luminaire, a neon tube or also an incandescent bulb. The radiator can comprise a multiplicity of individual light source or, in the case of a neon tube, also a long radiator. It would also be conceivable to dispose several light sources next to or one above the other.

The reflectors 83 to 86 have at least one reflecting surface 87 to 90 which are optically connected with the fluorescent tube 82. Herein the reflecting surfaces 87 to 90 are positioned so that the light from the fluorescent tube 82 impinging upon them is reflected or mirrored either onto the light guidance system 65 and/or onto a ceiling 91. The reflectors 83 to 86 have profile shape and serve also for the light guidance of specific rays 92 penetrating through the reflector system 65 onto the plane of the floor.

The reflector parts 79 of the light guidance system 65 are mirrors which reflect the solar radiation 93 impinging low into the interior room and solar radiation 94 impinging high not into the interior room. The reflector parts 80 are also made reflective but directed toward the interior room so that they reflect the rays 95 to 100 coming from the fluorescent tube 82 back into the interior room. The reflected rays 101 to 103, 92, 104 can as a function of the orientation, the forms, the position, and the surface of the reflectors 68 to 78 impinge for example on the ceiling or on the floor plane in the interior room. The reflectors 68 to 78 of the light guidance system 65 are all represented in FIG. 4 identically with respect to their form and orientation. However, it would also be conceivable to implement the reflectors differently and/or also to orient them differently in order to achieve further illuminating effects.

The light radiation 105 penetrating through the light guidance system 65 is captured by a reflector 85 of the artificial light illumination 106 and redirected onto the light guidance system 65 or onto the ceiling 91. The advantage of this construction resides therein that the light radiation does not penetrate to the work place and, consequently, can also not cause any disturbing dazzle effects. The optical coupling of the light guidance system 65 with the reflectors 83 to 86 of the artificial light illumination 106 permits the disposition of the reflectors 68 to 78 of the light guidance system at a greater distance with respect to one another in order to have a better view toward the outside without, however, having to accept the undesired dazzle effects. The reflectors 83 to 86 of the artificial light illumination 106, consequently, become part of the light guidance system 65. It is therefore also important that the reflectors 83 to 86 potentially are extended beyond the fluorescent tube 82 and lie as a band in front of the light guidance system 65 in order to take advantage of this dual function.

In FIG. 5 is represented an arrangement according to the invention in which a light guidance system 107 serves as abat-jour zone. The light guidance system 107, in turn, has a number of reflectors 108 to 112 which are disposed between two panes of glass 113, 114. The entire system 107 is fitted into a window frame 115, 116 which abuts a stop 117. Above the frame 115 is disposed a room ceiling 118 here indicated only schematically. On the frame 116 is flanged an artificial light source 218 comprising a reflector 119 and a luminaire 120. Below the stop 117 is provided a conventional insulating window 121. Important in this embodiment example is the implementation of reflector 119 which guides a portion of the light 123, 124 of luminaire 120 onto the light guidance system 107. The artificial light is, consequently, radiated intentionally into the daylight entrance opening. This process is customarily avoided as much as possible. Another portion 125, 126 of the light is radiated directly into the interior room in the direction toward the ceiling 118.

In FIG. 6 is shown in detail the artificial light source 218 with a window frame 129. On the window frame 129 abuts on the underside a casement of a window 130 with a conventional insulating window 131 and on the upper side a casement of a window 132 carrying the light guidance system 107. The artificial light source 218 is flanged on a projection 133 of the window frame 129 by means of a box 134. The reflector 119 of the artificial light source 218 is placed as involute/evolvente 135 around the luminaire 120 and extends subsequently to point 136. From this point 136 the first reflector part piece 137 is extended through a second reflector part piece 138 which is implemented planarly. This part piece 138 could also be implemented arc-form or parabola-form. Through the implementation of the first part piece as involute/evolvente the light 139, 140 of the luminaire 120 is radiated toward the window while the floor place is shaded.

In the box 134 is also disposed a fluorescent lamp ballast 141 for the control of the luminaire 120 if this is a fluorescent luminaire.

The embodiment example of FIG. 6 makes clear the advantage of the reflection system according to the invention. The artificial light source 218 can be implemented flat so that it can be screwed onto the projection 133 so that it becomes possible to open and close the upper and/or lower window casements 132, 130. With the known light sources such as for example a neon tube, the height of the box 134 is smaller than 5.5 cm, i.e. the artificial light source 218 can be screwed onto any conventional frame latching construction. A portion 142, 143, 144 of the light is radiated from the reflector 119 directly into the room.

In FIG. 7 is represented a further embodiment of an artificial light source 145. Herein a twin tube 146, 147 is enveloped by a reflector part piece 148 which extends from the twin tube 146, 147 to a point 149. This reflector part piece 148 is not constructed as involute or evolvente but, has, nevertheless an involute or evolvente shape. A second reflector part piece 150 extending from point 149 to the end point 151 is implemented parabolically.

In the embodiment example according to FIG. 7 the issue is solely that the light guidance system is completely irradiated. Therein it is less critical whether or not the reflector elements can be referred to in the mathematical sense precisely as involute, i.e. a projective imaging of a point, straight line, plane or hyperplane bundle or as evolvente, i.e. as plane curve which is obtained if all points of a given curve construct the tangent and on it the length of the arc from the contact point to a specific fixed point of the curve are measured off.

The light guidance system according to the invention is not limited to special dimensionings. However, if it is used for conventional living or office rooms its dimensions are determined by the conventional room sizes. In this case it is advantageous to dispose the artificial light sources at a distance of less than 0.5 m from the window area (FIG. 1) or less than 1 m in attic areas (FIG. 2, FIG. 3).

In the embodiment examples shown in the described Figures, the light-reflecting elements are always represented as rigidly disposed profiles forming an integral window unit with two panes of glass. Although this embodiment is particularly advantageous—cf. for example the production of such profiles according to the German Patent Application P 40 01 471.1—the invention is nevertheless not limited to it. Included are rather also controllable fins, whose relative angular position can be changed for example through a rope pull or the like. It is herein only essential that the fins can be brought into such an angular position that they reflect the irradiated artificial light into the room without blocking simultaneously the daylight.

It is also not absolutely required that the light-reflecting elements are disposed in a vertical axis extending parallel to two parallel panes of glass. It would, in contrast, also be possible to permit the axis of the light-reflecting elements to extend obliquely to the parallel panes of glass. In this case the individual elements would be disposed one above the other similar to roof tiles wherein however in contrast to the conventional roof tiles an intermediate space would be provided between the elements permitting the penetration of the natural outside light. Through the lateral offset in a parallel plane would be generated with each element a part piece projecting beyond the element disposed below. This part piece could radiate off into the interior room artificial light extending vertically from below to above, i.e. it would be possible to install the artificial light source itself into the space formed by the two panes of glass.

I claim:

1. A light guidance system for the illumination of an inside of a room with a light deflection device which deflects daylight coming from outside of the room as well as artificial light coming from inside of the room, characterized in that the light deflection device (7, 34, 58, 65, 107) comprises several elements (8–13; 37–51; 68–78) each having at least one reflector surface (53, 80) directed into the inside of the room (1) which reflector surface is formed by an element impervious to light, that these elements (8–13; 37–51; 68–78) are disposed parallel to one another and are arranged at such a distance from one another that light from outside of the room can penetrate through this distance into the inside of the room (1), and that an artificial light source (16, 54, 61, 82–86, 218) is provided which irradiates said at least one reflector surface (53, 80) from a direction from which the light from outside of the room is not substantially directly visible.

2. Light guidance system as stated in claim 1, characterized in that the reflector surfaces are formed on prisms.

3. Light guidance system as stated in claim 1, characterized in that the artificial light source (16, 54, 82 to 86, 218) is disposed at the level of a lowest of said several element (8, 37, 68, 128).

4. Light guidance system as stated in claim 1, characterized in that the artificial light source (61) is disposed at the level of a highest of said several elements.

5. Light guidance system as stated in claim 1, characterized in that the several elements (8 to 13; 37 to 51; 68 to 78; 108 to 112, 127, 128) are disposed between two transparent panes (4, 14; 66, 67; 113, 114) which, in turn, are surrounded by a casement (115, 116) on which is fastened the artificial light source (218).

6. Light guidance system as stated in claim 1, characterized in that the several elements (127, 128) are disposed between two transparent panes (113, 114) and are surrounded by a casement (132) wherein this casement (132) abuts a stop (129, 133) on which is fastened the artificial light source (218).

7. Light guidance system as stated in claim 1, characterized in that the artificial light source (106) comprises a light source (82) and several reflectors (83 to 86).

8. Light guidance system as stated in claim 1, characterized in that the artificial light source (16, 54, 61, 82 to 86, 218) comprises a light source (18, 55, 120) and a reflector (17, 56, 119).

9. Light guidance system as stated in claims 8 or 7, characterized in that the light source (18, 15, 82, 120) is a line-form light source for example a fluorescent tube.

10. Light guidance system as stated in claim 7, characterized in that the reflector (145) has an involute-form part piece (148) which is conjoined by a parabolic part piece (150).

11. Light guidance system as stated in claim 1, characterized in that the reflector (119) has at least one part piece (137) which is implemented as an involute-form, and that this part piece (137) is conjoined by a straight piece (138).

12. Light guidance system as stated in claim 1, characterized in that the brightness of the artificial light source (16, 54, 61, 82 to 86, 218) is regulated as a function of the brightness in the inside of the room.

13. Light guidance system as stated in claim 1, characterized in that the artificial light source (16, 54, 61, 82 to 86, 218) irradiates an entire inner surface of the light deflection device (7, 34, 58, 107).

14. Light guidance system as stated in claim 1, characterized in that all of said several elements (8 to 13, 37 to 51) are irradiated essentially with the same brightness from the artificial light source (16, 54, 61, 82 to 86, 218).

15. Light guidance system as stated in claim 1, characterized in that the artificial light source (145) comprises several light sources (146, 147).

16. Light guidance system as stated in claim 1, characterized in that the reflector surfaces (53, 80) directed into the inside of the room (1) reflect the light of the artificial light source (16, 54, 61, 82 to 86, 218) to a ceiling (2, 91, 118) of the inside of the room (1).

17. Light guidance system as stated in claim 1, characterized in that the elements (8 to 13; 37 to 51) are implemented so that they reflect the light coming from the outside of the room onto a ceiling (2, 91, 118) of the inside of the room (1).

18. Light guidance system as stated in claim 1, characterized in that the elements (8 to 13; 37 to 51) have in each instance two reflecting surfaces (51, 52) directed toward to the outside wherein one reflecting surface of a first element (51) reflects the light coming from the outside onto a second reflecting surface of a second element (50).

* * * * *